US010159861B2

(12) United States Patent
Nadeau et al.

(10) Patent No.: US 10,159,861 B2
(45) Date of Patent: Dec. 25, 2018

(54) METHOD FOR DELIVERING A LIQUID PRESSURISED BY THE COMBUSTION GASES FROM AT LEAST ONE PYROTECHNIC CHARGE

(71) Applicant: HERAKLES, Le Haillan (FR)

(72) Inventors: Jean-Paul Nadeau, Ollioules (FR); Frédéric Marlin, Saint Medard en Jalles (FR); Evrard Borg, Eysines (FR)

(73) Assignee: ARIANEGROUP SAS, Paris (FR)

( * ) Notice: Subject to any disclaimer, the term of this patent is extended or adjusted under 35 U.S.C. 154(b) by 46 days.

(21) Appl. No.: 14/392,170

(22) PCT Filed: Jun. 27, 2014

(86) PCT No.: PCT/FR2014/051644
§ 371 (c)(1),
(2) Date: Dec. 23, 2015

(87) PCT Pub. No.: WO2014/207403
PCT Pub. Date: Dec. 31, 2014

(65) Prior Publication Data

US 2016/0175628 A1 Jun. 23, 2016

(30) Foreign Application Priority Data

Jun. 28, 2013 (FR) ..... 13 56287

(51) Int. Cl.
*A62C 13/22* (2006.01)
*A62C 35/02* (2006.01)
*A62C 35/08* (2006.01)

(52) U.S. Cl.
CPC ..... *A62C 13/22* (2013.01); *A62C 35/023* (2013.01); *A62C 35/08* (2013.01)

(58) Field of Classification Search
CPC ..... A62C 13/22; A62C 35/023; A62C 35/08
(Continued)

(56) References Cited

U.S. PATENT DOCUMENTS 5,608,183 A 3/1997 Barnes et al.
5,660,236 A * 8/1997 Sears ..... A62C 13/22 169/33
(Continued)

FOREIGN PATENT DOCUMENTS

EP 0 784 998 A2 7/1997
EP 1 216 977 A2 6/2002
(Continued)

OTHER PUBLICATIONS

International Search Report as issued in International Patent Application No. PCT/FR2014/051644, dated Nov. 24, 2014.
(Continued)

*Primary Examiner* — Jason Boeckmann
(74) *Attorney, Agent, or Firm* — Pillsbury Winthrop Shaw Pittman LLP

(57) ABSTRACT

A method for delivering a liquid contained in a reservoir, the reservoir having a port for delivering the liquid which is closed off by a blow-out disk that is removable at a threshold pressure applied to the liquid, includes: the combustion of a pyrotechnic charge to generate combustion gases, the pressurization of the liquid by the combustion gases, and the removal of the removable blow-out disk from the delivery port and the delivery of the pressurized liquid. The flow rate of generated combustion gases during the delivery of the liquid ensures virtually constant pressurization of the liquid and thus the delivery of the liquid at a virtually constant flow rate. The pressure of the liquid during the delivery of the liquid varying only by a maximum of +/−30% with respect to its initial value at the time at which the blow-out disk is removed.

9 Claims, 2 Drawing Sheets

Figure 1:
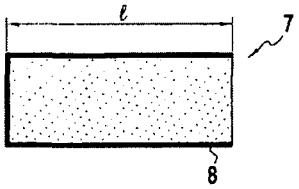
Figure 1:
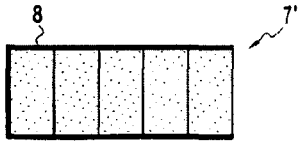

(58) Field of Classification Search
USPC ..... 169/46, 44, 12, 72, 84, 85
See application file for complete search history.

(56) References Cited

U.S. PATENT DOCUMENTS

| | | | | |
|---|---|---|---|---|
| 5,682,013 | A | 10/1997 | Smith et al. | |
| 6,143,102 | A | 11/2000 | Mendenhall et al. | |
| 8,020,628 | B2 * | 9/2011 | Fabre ..... | A62C 35/023 169/14 |
| 2005/0115721 | A1 | 6/2005 | Blau et al. | |
| 2007/0204593 | A1 | 9/2007 | Cover et al. | |
| 2010/0101442 | A1 | 4/2010 | Gauthier et al. | |

FOREIGN PATENT DOCUMENTS

| | | | | |
|---|---|---|---|---|
| EP | 1 552 859 | A1 | 7/2005 | |
| EP | 1552859 | A1 * | 7/2005 | ..... A62C 13/66 |
| EP | 1 782 861 | A1 | 5/2007 | |
| FR | 2 275 425 | A1 | 1/1976 | |
| FR | 2 714 374 | A1 | 6/1995 | |
| FR | 2 772 370 | A1 | 6/1999 | |
| FR | 2 866 022 | A1 | 8/2005 | |
| FR | 2 891 822 | A1 | 4/2007 | |
| FR | 2 892 117 | A1 | 4/2007 | |
| FR | 2 899 227 | A1 | 10/2007 | |
| FR | 2 902 783 | A1 | 12/2007 | |
| FR | 2 915 746 | A1 | 11/2008 | |
| FR | 2 950 624 | A1 | 4/2011 | |
| FR | 2 964 656 | A1 | 3/2012 | |
| FR | 2 975 097 | A1 | 11/2012 | |
| FR | 2 981 338 | A1 | 4/2013 | |
| JP | H09-192252 | A | 7/1997 | |
| JP | 2000-219588 | A | 8/2000 | |
| JP | 2010-515507 | A | 5/2010 | |
| WO | WO 2006/134311 | A2 | 12/2006 | |
| WO | WO 2007/113299 | A1 | 10/2007 | |
| WO | WO 2008/025930 | A1 | 3/2008 | |
| WO | WO 2009/056574 | A1 | 5/2009 | |

OTHER PUBLICATIONS

Office Action as issued in Japanese Patent Application No. 2016-522711, dated Jan. 16, 2018.

* cited by examiner

FIG.1.1

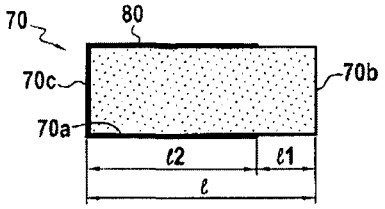
FIG.2
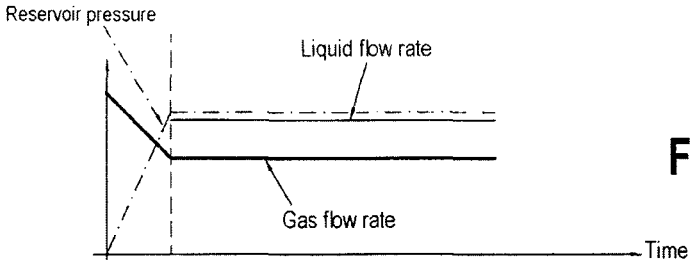
FIG.2.1
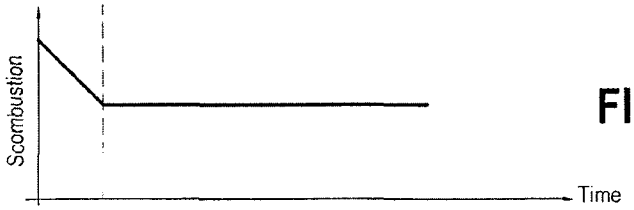
FIG.2.2
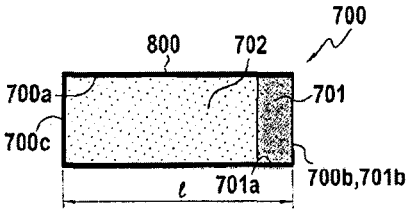
FIG.3
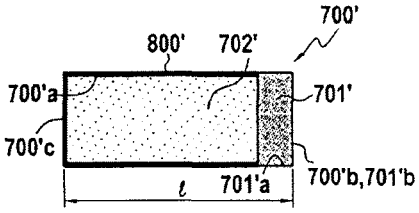
FIG.4
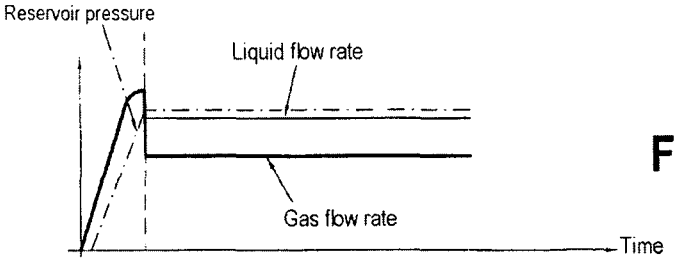
FIG.3.1

METHOD FOR DELIVERING A LIQUID PRESSURISED BY THE COMBUSTION GASES FROM AT LEAST ONE PYROTECHNIC CHARGE

CROSS-REFERENCE TO RELATED APPLICATIONS

This application is the U.S. National Stage of PCT/FR2014/051644, filed Jun. 27, 2014, which in turn claims priority to French patent application number 1356287 filed Jun. 28, 2013. The content of these applications are incorporated herein by reference in their entireties.

The present invention relates to a method for delivering a liquid contained in a reservoir, said liquid being pressurized by the combustion gases from at least one pyrotechnic charge. It also relates to pyrotechnic charges suitable for implementing this method. This method is suitably implemented for the delivery of a fire extinguishing agent liquid. The method according to the invention (and its prior art) is (are) described more particularly in this context. This is in no way limiting, however.

PRIOR ART

Fire extinguishing devices (examples of liquid delivery devices) generally comprise a reservoir containing an extinguishing agent (liquid agent). Said agent is intended to be diffused over the region of a fire, in order to extinguish said fire but also to prevent it from spreading.

Conventional extinguishers having a reservoir are permanently pressurized (they consist essentially a) of a reservoir under gas pressure containing the extinguishing agent, or b) of a bottle of pressurized gas connected to the extinguishing agent container (reservoir), said bottle, once it has been struck, releasing the gas for pressurizing the extinguishing agent). Therefore, the use of these extinguishers comprises the permanent storage under pressure of an extinguishing agent (variant a) or of a propellant gas for such an extinguishing agent (variant b), with the necessary operations of monitoring and verification (such as periodic weighing) that this involves. Since the pressure of the gas (variants a and b) furthermore varies with temperature, the range of temperatures at which the extinguisher can be used is consequently limited. Generally, the operation of such an extinguisher is sensitive to temperature. Moreover, during the delivery of the extinguishing agent, the volume available for the gas increases and thus the pressure of said gas decreases, resulting in an inevitable drop in the delivery flow rate of the extinguishing agent and a reduction in the effectiveness of the diffusion (dispersion or spraying or propulsion) of said agent. In order to remedy this drawback, provision is generally made of a higher pressure at the start of delivery (of the extinguishing agent), causing the structure of the device to be oversized and thus causing an increase in the weight and a higher cost of the device.

As an alternative to these permanently pressurized devices, devices comprising a pyrotechnic gas generator have been proposed, in particular to combat fires in the engines of aircraft, the pyrotechnic gases generated by said generator being suitable for pressurizing and delivering the liquid extinguishing agent. Such devices having a pyrotechnic gas generator are efficient, effective and particularly advantageous in that their use does not involve the storage and management of gases under pressure.

Patent application EP 1 782 861 describes a fire extinguishing device comprising a (liquid) extinguishing agent reservoir and means for generating a gas under pressure, said means being able to consist of a pyrotechnic gas generator. A separating element, for example a flexible membrane, is provided to separate said gas generator from said extinguishing agent. During the operation of said generator, the membrane deploys under the effect of the pressure of the generated gases and drives the extinguishing agent from the reservoir via a calibrated blow-out disk after said calibrated blow-out disk has ruptured under the effect of the pressure of said extinguishing agent.

Patent application EP 2 205 325 describes a device comprising a cylindrical body accommodating a sliding piston that defines on one side a chamber, forming a reservoir, filled with the extinguishing agent (liquid, at its saturation vapor pressure, under a gaseous headspace) and on the other side a chamber that contains a pyrotechnic gas generator. When the gas generator is actuated, the pressure of the gases moves the piston such that the extinguishing agent is expelled from the reservoir.

Patent application WO 2008/025930 describes a pyrotechnic gas generator suitable for operating extinguishers of the abovementioned types. The pyrotechnic charge of the generator advantageously consists of at least one monolithic block, which is solid or has a central duct, with large dimensions (non-inhibited, i.e. without a combustion inhibitor at its surface): a cylindrical monolithic block of which the two dimensions, thickness and diameter, are between 10 and 75 mm. The composition of this pyrotechnic charge is advantageously based on basic copper nitrate (BCN) and guanidine nitrate (GN).

Patent application WO 2007/113299 also describes pyrotechnic objects or blocks that are substantially cylindrical with large dimensions and are able to be used in pyrotechnic gas generators for operating extinguishers of the abovementioned types.

It is actually clear that the pyrotechnic charges (blocks of propellant) used must have sufficient dimensions to give the gas generator an operating life that is compatible with the desired extinguishing function. This operating life is greater than that required in the field of automotive safety, more particularly for the operation of the airbags and the pyrotechnic actuators such as seatbelt pre-tensioners and hood lift actuators.

However, the profile of the flow rate of gases generated by such generators still decreases greatly. First, the combustion surface of the at least one block of propellant in question decreases during combustion. Second, as already indicated above, since the free volume of the extinguisher increases during the expulsion of the liquid, the pressure applied to the liquid drops during the delivery of said liquid (hence the drop in delivery flow rate of said liquid). To this end, FIGS. 1 to 3 of said application WO 2007/113299 can be considered. These figures show the continually and sharply decreasing profile of the pressure applied to the liquid by the gases generated by the combustion of these pyrotechnic charges that are formed of such cylindrical blocks of propellant. These figures also show that greater are the dimensions of the blocks, longer is the duration of pressurization.

Thus, as indicated above, the use of these pyrotechnic charges that consist of these blocks of propellant in this type of architecture (extinguishing devices having pyrotechnic gas generators) makes it necessary to oversize the structural elements of the extinguisher in order that these elements withstand a pressure, at the start of delivery of the liquid, that is high (greater than the average pressure during the operation of the extinguisher), so as to ensure a sufficient pressure at the end of spraying (in spite of the drop in pressure associated with the greatly decreasing pressurization profile).

INVENTION

In such a context, which is the general context of the delivery of a liquid following its pressurization by pyrotechnically generated combustion gases, more particularly the context of the operation of extinguishers of the above type, the inventors propose an improvement. This improvement can be analyzed in terms of a method (optimization of the delivery profile of said liquid) and of a device (the optimization of said delivery profile making it possible to lighten the device (or even reduce the oversizing mentioned above)).

For information, it will be noted here that the duration of delivery of the pressurized liquid is typically a few seconds to a few tens of seconds for an extinguisher.

According to its first subject, the present invention thus relates to a method for delivering a liquid, notably an extinguishing agent liquid, contained in a reservoir, said reservoir having at least one port for delivering said liquid which is closed off by a blow-out disk that is removable at a threshold pressure applied to said liquid (if there are a plurality of delivery ports, each of these are closed off by a blow-out disk that is removable at a threshold pressure of the same intensity). Said removable blow-out disk is advantageously of such a type as to be removed without impairing the running of the method in any way (i.e. the operation of the device in which said method is implemented), without notably creating fragments or debris. It is thus advantageously of the type of a membrane which is frangible in the form of petals or of a spring-loaded valve.

Conventionally, said method comprises:

the combustion of at least one pyrotechnic charge in order to generate combustion gases, the pressurization of said liquid under the action of said combustion gases, and the removal of said removable blow-out disk from said at least one delivery port and the delivery of said pressurized liquid.

Conventionally, said method thus comprises a transitional phase during which the combustion gases from the pyrotechnic charge pressurize the liquid until the blow-out disk has been removed from the at least one delivery port, followed by an "active phase": that of the delivery of the liquid. Generally, the aim is to shorten the duration of this transitional phase (which constitutes a delay time between the detection of the event and the response to said event). Let it be noted, however, that knowingly giving this transitional phase a "considerable" duration cannot be fully excluded from the scope of the invention; this having the aim, in the context of extinguishers for example, of reproducing the operating conditions of prior art extinguishers (which are pressurized by a gas bottle), the user being used to these conditions. The management of the transitional phase preceding delivery will be returned to below.

Characteristically, a) in the context of implementing the method according to the invention, the flow rate of generated combustion gas during the delivery of the liquid ensures a virtually constant pressurization of said liquid and thus the delivery of said (pressurized) liquid at a virtually constant flow rate. The notion of virtually constant pressurization is quantified in the following: the pressure of said liquid during the delivery of said liquid varies only by a maximum of +/−30%, advantageously only by a maximum of +/−20%, very advantageously only by a maximum of +/−10% with respect to its initial value at the time at which said blow-out disk(s) is (are) removed. It is understood that the virtually constant delivery flow rate of the liquid is thus likely to vary, entirely logically, only in the same proportions (by a maximum of +/−30%, advantageously by a maximum of +/−20%, very advantageously by a maximum of +/−10% with respect to its initial value at the time at which said blow-out disk(s) is (are) removed).

Let it already be noted here that the delivery of the liquid is advantageously implemented, in a dispersed form, by way of a (spray) nozzle. In such a case, the sensitivity of the delivery flow rate to the variations in pressure of said liquid is reduced (said delivery flow rate through a nozzle complying, as a general rule, with a $P^n$ law, where P is the pressure of said liquid and n is <1). The delivery flow rate of the liquid through a nozzle, in the abovementioned ranges of variation in pressure of the liquid, is thus likely in fact to vary only by a maximum of +/−15%, advantageously only by a maximum of +/−10%, very advantageously only by a maximum of +/−5%. A virtually constant pressure, $P+/-\Delta P$, where $\Delta P$ is as defined in the preceding paragraph, makes it possible, under these advantageous conditions of delivery of the liquid, to ensure a virtually constant delivery flow rate, $Q+/-\Delta Q$, where $\Delta Q$ is as defined in the present paragraph ($\Delta Q<\Delta P$), and thus a very advantageous, constant, spray quality.

Characteristically, the delivery of the (pressurized) liquid is thus implemented at a virtually constant flow rate on account of virtually constant pressurization of said liquid. In this way, the method according to the invention is original. Let it be noted incidentally here that the delivery of the pressurized liquid at a virtually constant flow rate involves a virtually constant (decreasing) variation in the volume taken up by said liquid (the volume in the reservoir) and corresponds to a virtually constant (increasing) variation in the volume taken up by the pressurizing gases.

Characteristically, b) the method according to the invention is implemented in a device comprising said liquid reservoir and at least one pyrotechnic gas generator containing said at least one pyrotechnic charge (the combustion of which generates the combustion gases necessary to pressurize the liquid); said at least one pyrotechnic gas generator being connected to said reservoir and a mobile member for separating the generated combustion gases and said liquid being provided within said device. The presence of this mobile separating member is advantageous in several ways. First of all, said mobile member helps to keep the pressurization of the liquid constant as desired (see above), on account of the "balancing" of the pressures applied to its surface. Said mobile member is also advantageous on account of the separating function (combustion gases/liquid) that it exerts. It may be particularly expedient to protect the liquid from the gases. In any event, the formation of a foam, which is disadvantageous for effective delivery of liquid, should be avoided.

It is not out of the question for the device according to the invention to comprise at least one nozzle (nozzle having an adjustable throat area or a constant throat area), through which the generated combustion gases are output (evacuated from said at least one pyrotechnic generator). However, according to a particularly preferred variant embodiment, said device does not contain such a nozzle. The desired result (as regards the virtually constant pressurization of the liquid) can easily be achieved without the use of any nozzle (see below). Thus, the device according to the invention can have a very simple design.

In the light of the remarks above, a person skilled in the art will already fully understand the interest of the method according to the invention. The virtually constant pressurization avoids the oversizing of the structural elements of the prior art reservoirs (this oversizing being intended to withstand a high pressure level at the start of liquid delivery, brought about by the decrease in pressure over time) and thus makes it possible to work in lighter structures (within which the problem of gas/liquid mixtures does not arise). The virtually constant delivery flow rate ensures a virtually constant effectiveness of the liquid delivered throughout delivery.

In order to ensure virtually constant pressurization during the delivery of the liquid (see above), it is necessary for the product of the number of moles N of pressurizing gases multiplied by the temperature T of said gases, divided by the volume V of the pressurized reservoir (N×T/V) to be virtually constant (and thus to vary only by a maximum of +/−30%, advantageously only by a maximum of +/−20%, very advantageously only by a maximum of +/−10%).

As a general rule, the temperature of the pressurizing gases does not vary significantly during the delivery of the liquid. However, it is possible, on account for example of the heat losses of a device that has little thermal insulation and thus takes time to heat, for the temperature T of said gases to vary slightly by increasing ($\Delta T<100°$ C.) during the delivery of the liquid.

In such cases (where the temperature of the pressurizing gases thus varies slightly by increasing during the delivery phase of the liquid), in order to ensure virtually constant pressurization of the liquid, it is then necessary for the flow rate of combustion gases supplied by the pyrotechnic charge to decrease slightly (N↘) during the delivery of said liquid; this is in order to compensate for the slight increase (T↗) in the temperature of the combustion gases, i.e. to ensure a constant product N×T/V.

Of course, the prior art pyrotechnic charges, the combustion surfaces of which are entirely free (i.e. the entire surface of said charges is able to burn), have, during their combustion, a combustion surface that decreases greatly, and are thus not suitable for generating a slightly decreasing gas flow rate.

To this end, it is possible to use a means that is well known to a person skilled in the art, for example as described in patent application US 2007/0204593, i.e. a primed nozzle having an adjustable, optionally driven, throat area at the outlet of a combustion chamber containing the burning pyrotechnic charge ($\Delta T$ is compensated by a suitable $\Delta N$ by virtue of said nozzle). The throat area of the nozzle At, which regulates the internal pressure P in the combustion chamber in a manner correlated with the combustion surface Sc of the pyrotechnic charge, thus regulates the combustion rate Vc of the propellant of the pyrotechnic charge, which then delivers the required flow rate of combustion gases m (the number N of moles required) in accordance with Paul Veille's law:

$$m=\rho\cdot Sc\cdot Vc=P\cdot Cd\cdot At \text{ (where } Vc=a\ P^n$$

Vc is the combustion rate of the propellant in mm/s
P: the pressure in MPa
a: the pressure coefficient
n: the pressure exponent
ρ: the density of the propellant
a: the pressure coefficient of the combustion rate law
n: the pressure exponent of the combustion rate law
At: the area of the throat of said nozzle as indicated above
Cd=1/C*: the flow rate coefficient).

A slightly decreasing gas flow rate can thus be obtained by combustion of a pyrotechnic charge ("of any geometry") in a combustion chamber equipped with a nozzle having an adjustable throat area (see above), but the inventors strongly recommend (see above) obtaining such a slightly decreasing gas flow rate by much simpler means that are particularly suitable in the context of extinguishers.

In an original manner, the applicant proposes, within the context of the invention, the use of specific pyrotechnic charges that are suitable for inducing a slightly decreasing combustion gas flow rate, the use of pyrotechnic charges that have a part of their combustion surface which is combustion-inhibited. Such types of pyrotechnic charge have hitherto been used in different contexts than that of the invention, notably in propulsion. The present invention in fact proposes an original prospect, an original use for this type of pyrotechnic charge.

A person skilled in the art knows, in a general manner, to inhibit the combustion of a part of the combustion surface of a pyrotechnic charge by covering said part with a layer of suitable material (combustion-inhibiting material) which is very often in the form of a (noncombustible) varnish. Such combustion inhibition has been described in numerous prior art documents and notably in patent application FR 2 275 425 and patent U.S. Pat. No. 5,682,013.

A person skilled in the art is in fact aware of several types of pyrotechnic charge that have a part of their combustion surface which is combustion-inhibited, said several types of pyrotechnic charge being suitable for generating, by combustion, a slightly decreasing gas flow rate with, therefore, a combustion surface that decreases slightly in size.

Among pyrotechnic charges that are suitable for generating, by combustion, a slightly decreasing gas flow rate with a combustion surface that decreases slightly in size on account of the combustion inhibition of a part of their combustion surface, the following may be mentioned in a nonlimiting manner:

pyrotechnic charges which have the shape of a right cylinder with a circular cross section and which have a lateral surface extending along their entire length between two end faces, of the solid monolithic block type or of the "virtually perfect" stack of disks type (the stacked disks constitute a virtually monolithic structure); only one of their end faces being combustion-inhibited. Such charges are suitable in that they are only likely to burn on their lateral face and on one of their end faces;

pyrotechnic charges which have a frustoconical shape with a lateral surface extending along their entire length between two end faces, of the solid monolithic block type or of the "virtually perfect" stack of disks type (forming a virtually monolithic structure); their lateral surface and the end face with a smaller cross section being combustion-inhibited while the other end face, with a larger cross section, is not combustion-inhibited. Such charges are suitable in that they are only likely to burn in an end-burning manner or "conical cigarette"-type manner;

pyrotechnic charges which have a tubular shape with a lateral surface extending along their entire length between two end faces and also a central cylindrical or star-shaped duct, of the solid monolithic block type or of the "virtually perfect" stack of disks type (forming a virtually monolithic structure); their end faces being inhibited (their lateral surface not being inhibited). Such charges are suitable in that they burn in their duct (internal surface) and on their lateral surface.

In accordance with the exact features of the device in question, notably its thermal insulation, a person skilled in the art is able to optimize the pyrotechnic charges that have a part of their combustion surface which is combustion-inhibited, with a slightly decreasing flow rate, ensuring virtually constant pressurization of the liquid during the delivery phase.

The above-described charges were described with reference to the active phase. It will be readily understood that they can have, before being used, a uniform geometry, for a more considerable volume, such that they burn uniformly, successively, both during the transitional phase and during the active phase. Provision can also be made of a binary structure, notably in that an additional charge is secured to said above-described charges; said additional charge being intended to burn during the transitional phase, and advantageously being intended to burn so as to shorten said transitional phase.

In other cases, which are much more frequent, following the transitional phase, which helps to heat the device (more precisely following the removal of the blow-out disk(s), i.e. during the delivery phase of said liquid), the temperature of the pressurizing gases varies in an insignificant manner. Thus, in order to ensure a virtually constant pressurization of the liquid, it is sufficient for the flow rate of combustion gases supplied by the pyrotechnic charge to be virtually constant (to vary only by a maximum of +/−30%, advantageously only by a maximum of +/−20%, very advantageously only by a maximum of +/−10%).

Of course, a virtually constant gas flow rate can be obtained by combustion of a pyrotechnic charge ("of any geometry") in a combustion chamber equipped with a nozzle having an adjustable throat area (see above), but the inventors strongly recommend, here too, obtaining such a virtually constant gas flow rate by much more simple means that are particularly suitable in the context of extinguishers.

A virtually constant gas flow rate can thus be advantageously obtained, without making use of a nozzle having an adjustable throat area (see above), with a pyrotechnic charge which burns at a virtually constant combustion pressure (varying only by a maximum of +/−30%, advantageously only by a maximum of +/−20%, very advantageously only by a maximum of +/−10%) while having (during its combustion, therefore) a virtually constant combustion surface. Given the combustion rate laws of conventional propellants ($Vc=a\ P^n$, where n is generally between 0 and 0.6), a virtually constant combustion surface corresponds, within the meaning of the invention, to a combustion surface that varies only by a maximum of +/−15%, advantageously only by a maximum of +/−10%, very advantageously only by a maximum of +/−5%.

The virtually constant combustion pressure of a pyrotechnic charge having a virtually constant combustion surface can be ensured either by including the pyrotechnic charge in a volume at virtually constant pressure (this being the case, in the context of the invention, of the pressurization volume (inasmuch as the (increasing) variation of the volume taken up by the pressurizing gases corresponds to the (decreasing) variation of the volume taken up by the pressurized liquid, during the delivery of said pressurized liquid), or by including the pyrotechnic charge in a combustion chamber provided with a nozzle having a constant throat area (the use of such a nozzle (which is less sophisticated than that of a nozzle having an adjustable throat area (see above)) is advantageous in that it makes it possible to easily regulate the pressure). A person skilled in the art knows that the pressure exponent of a propellant that forms a pyrotechnic charge needs to be less than 1 in order to ensure a constant combustion rate at constant pressure, advantageously less than 0.8, very advantageously less than 0.6. When said pyrotechnic charge is combusted, while being included in a volume at virtually constant pressure, without a nozzle, a person skilled in the art knows that it is preferable, in order to ensure that the combustion rate and thus the gas flow rate is constant, to choose a propellant having a pressure exponent less than 0.3, advantageously less than 0.2, very advantageously less than 0.1.

A virtually constant combustion surface, which is suitable for inducing a virtually constant combustion gas flow rate at a virtually constant combustion pressure, can, for its part, be obtained with pyrotechnic charges that have a part of their combustion surface which is combustion-inhibited.

It has been shown above that a person skilled in the art knows to inhibit the combustion of a part of the combustion surface of a pyrotechnic charge by covering said part with a layer of suitable material (combustion-inhibiting material), which is very often in the form of a (noncombustible) varnish, such combustion inhibition being described in several prior art documents and notably in patent application FR 2 275 425 and patent U.S. Pat. No. 5,682,013.

In fact, a person skilled in the art is aware of several types of pyrotechnic charge that have a part of their combustion surface which is combustion-inhibited, suitable for generating, by combustion, a virtually constant gas flow rate at a virtually constant pressure with a virtually constant combustion surface. Such types of pyrotechnic charge have hitherto also been used in different contexts than that of the invention, notably in propulsion. The present invention proposes, here too, an original prospect, an original use for this type of pyrotechnic charge.

Among the pyrotechnic charges that are suitable for generating, by combustion, a virtually constant gas flow rate at a virtually constant pressure with a virtually constant combustion surface on account of the combustion inhibition of a part of their combustion surface, the following may be mentioned in a nonlimiting manner:

pyrotechnic charges (of a first type which can be referred to as type A, shown schematically in the appended FIGS. 1 and 1') which have the shape of a right cylinder with a circular cross section and which have a lateral surface extending along their entire length between two end faces, of the solid monolithic block type or of the stack of disks type; their lateral surface and one of their end faces being combustion-inhibited while the other end face is not combustion-inhibited. Such charges are suitable in that they are only likely to burn in an end-burning manner or "cigarette"-type manner;

pyrotechnic charges (of a second type which can be referred to as type B) which have a tubular shape with a lateral surface extending along their entire length between two end faces and also a central cylindrical duct, of the solid monolithic block type or of the "virtually perfect" stack of disks type (the stacked disks forming a virtually monolithic structure); only one of their end faces being combustion-inhibited. Such charges are suitable in that they burn on their lateral surface (external surface), in their duct (internal surface) and on their non-inhibited end face;

pyrotechnic charges (of a third type which can be referred to as type C) which have a tubular shape (of outside diameter D1) with a lateral surface extending along their entire length between two end faces and also a central cylindrical duct (of diameter D2), of the solid monolithic block type or of the "virtually perfect" stack of disks type (the stacked disks forming a virtually monolithic structure); (only) their lateral surface being combustion-inhibited and their length being equal or more or less equal to 1.5 times their outside diameter (D1) plus 0.5 times the diameter of their central duct (D2);

pyrotechnic charges (of a fourth type which can be referred to as type D) which have a tubular shape with a lateral surface extending along their entire length between two end faces and also a central star-shaped duct with at least 5 arms, of the solid monolithic block type or of the "virtually perfect" stack of disks type (forming a virtually monolithic structure); their lateral surface being combustion-inhibited. Such charges are suitable in that they burn in their duct (internal surface) and on their end faces.

The pyrotechnic charges of the first type above (type A) are largely preferred because their architecture is simple and their combustion surface and thus their flow rate of (generated combustion) gases at constant pressure approach a virtually perfect constant. In addition, the way in which they burn (end-burning or "cigarette"-type burning) is particularly suitable for ensuring combustion of long duration. The pyrotechnic charges of type A are thus very particularly suitable for generating a virtually constant gas flow rate during the delivery phase of the liquid, or even during the phase of pressurizing and delivering the liquid (cf. below).

Let it be noted here that the abovementioned pyrotechnic charges, notably those of the types specified above, have been described with reference to the implementation of the "active phase" of the method according to the invention: that of delivering the liquid. It should thus be understood that, during the delivery of the liquid, the burning pyrotechnic charge is advantageously of the type A, B, C or D above, very advantageously of the type A above. Thus, very advantageously, during the delivery of said liquid, the at least one pyrotechnic charge, which has the shape of a right cylinder with a circular cross section and which have a lateral surface extending along its entire length between two end faces, of the solid monolithic block type or of the stack of disks type, is end-burning only; its lateral surface and its end face away from the combusting end face being combustion-inhibited.

In a general manner, before it is used to implement the method according to the invention, the at least one pyrotechnic charge (intended to be burned) has in fact an overall structure which comprises a part (a portion) intended to be burned during the transitional phase (prior to the delivery phase) and another part (another portion) intended to be burned during the "active phase" (delivery phase of the pressurized liquid). Thus, it can have a uniform overall structure, for an "uniform" combustion during the transitional phase and during the "active phase", or have a "more complex", at least binary, nonuniform overall structure for a priori a different combustion during the transitional phase and during the "active phase".

Thus:

according to a first variant embodiment of the method according to the invention, the flow rate of combustion gas generated by the at least one pyrotechnic charge increases, or increases and is then virtually constant, or is virtually constant (Q1) during the pressurization phase of the liquid (transitional phase that concludes with the removal of the blow-out disk (blow-out disks)) (and is virtually constant during the delivery of the liquid); and according to a second variant embodiment of the method according to the invention, the flow rate of combustion gas generated by the pyrotechnic charge during the pressurization phase of the liquid is managed, controlled, so as to shorten said pressurization phase of the liquid (transitional phase that concludes with the removal of the blow-out disk (blow-out disks)): it is in fact increased compared with the above flow rate Q1. Said charge has two combustion regimes, the first ensuring a "high" flow rate (increased compared with Q1) during the pressurization phase and the second a virtually constant flow rate during the delivery phase.

It has been indicated above that the desire to give the transitional phase a "considerable" duration is not ruled out. Thus, a third variant in which the flow rate of generated combustion gas during the pressurization of the liquid is decreased (with respect to the flow rate Q1 above) cannot be completely ruled out.

In order to implement the first variant, it is possible in particular to work, during the two phases (the transitional phase and the "active phase"), in the same combustion mode, with at least one pyrotechnic charge of uniform structure, advantageously in the same "cigarette"-type combustion mode with at least one pyrotechnic charge of type A (see above).

In order to implement the second and third variants, it will be understood that the at least one pyrotechnic charge has an at least binary structure with a part (portion) which generates combustion gases at an increased flow rate (second variant) or a reduced flow rate (third variant) and another part (another portion) that generates combustion gases at a virtually constant flow rate during the delivery of the liquid, hence the above notion of a nonuniform overall structure. It will be understood that the first portion can exist in numerous variants, in terms of its shape (cylindrical, frustoconical, cubic shape, for example), and in terms of its constitution (solid monolithic block, stack of structures such as disks, cylinders or cubes, for example).

Modes of operation of the method according to the invention according to the second variant above are specified below in an entirely nonlimiting manner.

When it is desired to shorten the pressurization phase, use can be made of at least one pyrotechnic charge, which has the shape of a right cylinder with a circular cross section and which have a lateral surface extending along its entire length between two end faces, of the solid monolithic block type or of the stack of disks type; its lateral surface that is combustion-inhibited along a part of the length of the cylinder starting from one of its end faces, which is itself combustion-inhibited, not being combustion-inhibited along the complementary part of the length of the cylinder starting from the other of its end faces which is not combustion-inhibited. This charge, of type A' (with reference to the charge of type A above; shown schematically in the appended FIG. 2), is end-burning and side-burning during the pressurization of the liquid (transitional phase). Its initial combustion surface, corresponding to the entire non-inhibited surface of the cylinder (one of its end faces and a part of its lateral surface starting from said end face) then decreases so as to be limited to the end surface of the inhibited part of the cylinder. The flow rate of generated gas is thus high during the pressurization phase (the transitional phase) in order to rapidly reach the pressure for removing the blow-out disk (blow-out disks) and is then constant so as to ensure the desired delivery of the liquid at constant pressure.

When it is desired to shorten the pressurization phase, use can also be made of at least one pyrotechnic charge of type A" (likewise with reference to the charge of type A above), which has two parts (two portions): a first part (a first portion) which is in one piece (=solid monolithic block) or is not in one piece (=stack of structures, such as disks, cylinders or cubes), is intended to burn, during the pressurization of the liquid, and has a combustion rate at a given pressure $Vc_1=a_1P^n{}_1$ that is higher than that $Vc_2=a_2P^n{}_2$ (where advantageously $n_1>n_2$, very advantageously $n_1>>n_2$) of the complementary part (of the second portion), which is in one piece (=solid monolithic block) or is not in one piece (=stack of disks), of said at least one pyrotechnic charge, said second part (second portion) being intended to burn (in an end-burning manner) during the delivery of the liquid. With reference to the combustion of propellants in question, the pyrotechnic charge of type A" can thus consist of a first portion, on the side of the end face that is not combustion-inhibited, of a propellant that has a high combustion rate $Vc_1(P)$, and of a second juxtaposed portion of another propellant that has a slower combustion rate $Vc_2(P)$. The mode of operation of such a pyrotechnic charge is thus as follows: during the pressurization of the liquid, a (first) part, which is not combustion-inhibited or a part of the combustion surface of which is combustion-inhibited, of the pyrotechnic charge burns at a high combustion rate in order to pressurize said liquid over a short period until said blow-out disk is removed, and then, during the delivery of said liquid, the complementary part of said pyrotechnic charge, which has the shape of a right cylinder with a circular cross section and which have a lateral surface extending along its entire length between two end faces, of the solid monolithic block type or of the stack of disks type, said lateral surface and said end face away from the end face burning being combustion-inhibited, burns at a moderate combustion rate so as to ensure the delivery of said liquid for a long duration.

During the pressurization phase of the liquid, such a multicomponent, at least two-component, pyrotechnic charge thus generates, with a constant or nonconstant combustion surface, a first gas flow rate that pressurizes said liquid over a short period (resulting from the combustion of the first portion made up of at least one propellant that has a high combustion rate), making it possible to reach the pressure for removing the blow-out disk(s) in a short period, and then, during the delivery phase of the liquid, a second gas flow rate over a long period, which is constant and at constant pressure, (resulting from the "cigarette"-type combustion of the second portion made up of a propellant that has a lower combustion rate) ensuring the constant pressurization of said liquid for a long period.

It has been shown above that the first part of the at least one two-component charge of type A" can, at least in part, be inhibited (type A"1; shown schematically in the appended FIG. 3) or not inhibited (type A"2; shown schematically in the appended FIG. 4). It will be understood that the non-inhibition of the part having a high combustion rate is even more favorable for shortening of the duration of the transitional phase. It will also be understood that the charge of type A"2 corresponds to a charge of type A', formed, for the non-inhibited part of its lateral surface, of a propellant with a combustion rate $Vc_1(P)$ and, for the inhibited, complementary part of its lateral surface, of a propellant with a combustion rate $Vc_2(P)$: $Vc_1(P)>Vc_2(P)$.

It will be understood that the first portion can in fact exist in numerous variants, in terms, notably, of its shape and its constitution (see above), its number of components ($n\geq1$) and the identical or nonidentical composition of said components ($n\geq2$) (their identical or nonidentical combustion rate $Vc_1(P)$; said rate(s) $Vc_1(P)$ being, in any case, greater than that of the second portion), etc. Said first portion advantageously exists in the same geometry as that of the second portion (cylinder with a circular cross section) and, be it a single component or not, with combustion rate(s) $Vc_1(P)$ greater than that of the second portion.

It will be easily understood that at least two-component pyrotechnic charges of another type ($Vc_1(P)<Vc_2(P)$: see above) can be used to implement the third, less recommended, variant of the method according to the invention.

In a general manner, the combustion of the at least one pyrotechnic charge can be carried out with the combustion pressure being regulated. To this end, it is possible to implement said combustion in a combustion chamber provided with a nozzle (see above). This variant is advantageous inasmuch as the combustion pressure of the charge, and thus its combustion rate, are independent of the pressurization pressure of the liquid, thereby making it easier to regulate operation during the implementation of the method.

It will be recalled that the pressurized liquid is advantageously delivered in a dispersed form, by way of a nozzle. The delivery of the liquid at a constant flow rate then allows dispersion, by way of said nozzle, of constant quality throughout the delivery phase (see above).

The liquid in question may notably consist of a (fire) extinguishing agent (water, water+additives, etc.), a lubricant, a cooling agent (water, glycol, etc.), a cleaning and/or dispersant agent (surfactant liquid etc.). It is emphasized again here that the delivery of the liquid at a constant flow rate, using the method according to the invention, ensures a very advantageous supply of a constant quantity of liquid to the target which requires said supply of liquid (i.e. the fire to be extinguished and to be circumscribed, in the context of delivering an extinguishing agent; i.e. the machine which heats up, in the context of delivering a lubricant; i.e. the pollution to be combated, in the context of delivering a cleaning agent and/or dispersant, etc.).

As far as the devices suitable for implementing the method according to the invention are concerned (devices having a mobile separating member between the liquid reservoir and the pyrotechnic gas generator(s)), these may easily be devices described in the prior art, notably in patent applications EP 1 782 861 and EP 2 205 325. It is to the credit of the inventors to have selected this type of device (of simple design) for implementing the method according to the invention (very particularly with regard to the restrictions on the (virtually constant) pressurization of the liquid and in order to avoid any combustion gas/liquid contact). As indicated above, such devices comprise, in their structure, a reservoir (for the liquid to be delivered) and at least one pyrotechnic gas generator containing at least one pyrotechnic charge; said at least one pyrotechnic gas generator being connected to said reservoir and a mobile member for separating the generated combustion gases and said liquid being provided within said device. Such devices comprise, in their basic structure, a reservoir connected to a gas generator containing a pyrotechnic charge. It will be understood that their structure can in fact be more complex, with several generators, arranged, in parallel, upstream of the reservoir; each of said generators containing one or more charges. In any event, one or more generators are likely to output into one or more reservoirs. The device is thus likely to comprise a plurality of reservoirs. In any event, the method according to the invention is implemented at each of said reservoirs.

The device in question is advantageously a compact device (which thus has a limited space requirement). According to a first variant, such a compact device comprises a one-piece (unitary) body in which the reservoir and the at least one pyrotechnic generator are arranged. According to a second variant, within (the structure) of such a compact device, the at least one pyrotechnic generator is arranged in (the volume of) the reservoir.

As far as the mobile separating member is concerned, it has been shown that it can consist of a flexible membrane or a piston. It advantageously consists of a piston.

The method according to the invention is thus advantageously implemented in a device according to the first variant above, said device advantageously comprising in its structure a (one-piece) body with a sliding piston (=mobile separating member); said piston delimiting two chambers, a (front) first chamber that forms the reservoir and a (rear) second chamber that contains at least one pyrotechnic charge that forms a pyrotechnic gas generator. Such a device, which does not comprise a nozzle, is perfectly suitable for implementing the method according to the invention (see above).

The method according to the invention can thus also be implemented in a device according to the second variant above, said device advantageously comprising at least one pyrotechnic generator (generally a single such pyrotechnic generator) arranged in the top part of the (empty) internal volume of a reservoir that contains the liquid to be delivered. A flexible membrane partitions the internal volume of the reservoir (the combustion gases then acting on this membrane in order to act on the liquid) or is linked to said at least one gas generator (the combustion gases inflate such a membrane in order to act on the liquid). Such a device, which comprises or does not comprise (a) nozzle(s), advantageously not comprising a nozzle, is perfectly suitable for implementing the method according to the invention (see above).

The method according to the invention is thus advantageously implemented in devices of which the exact structure has been recalled above.

Obviously, it will be understood that the devices in question also comprise means for initiating combustion, i.e. a system for igniting the at least one pyrotechnic charge, which is gas generator. Such an ignition system generally comprises an initiator and an igniter. In a nonlimiting manner, it can be mentioned here that the initiator can consist:

of a mechanically or electrically activated pyrotechnic initiator that generates hot gases at the surface of the igniter, or of a mechanically or electrically activated non-pyrotechnic initiator that generates a hot spot on the surface of the igniter: such as a hot wire or a piezoelectric element; and that the igniter can consist:

of a "microrocket"-type pyrotechnic igniter that comprises a rapid combustion pyrotechnic charge (of the type with a double-base propellant or Butalite® composition) (mass~a few grams) disposed in a combustion chamber with a nozzle, the jet of which is directed toward the surface of the charge, and/or of an igniter that consists of one or more vigorously reacting ignition pellets (the composition of which is of the $B/KNO_3$ or $TiH_2/KClO_4$ or $NH_4ClO_4/NaNO_3$/binder type), disposed on the free surface of the pyrotechnic charge, and/or of an igniter that consists of one or more pellets (the composition of which is of the basic copper nitrate (BCN)/guanidine nitrate (GN) type).

It will be understood that, during the transitional phase (pressurization phase), the pyrotechnic igniter also contributes toward the generation of gas. It may be dimensioned to contribute in a non-negligible manner to the supply of gas during said transitional phase, notably when it is desired to shorten said transitional phase.

As far as the composition of the pyrotechnic charges that are useful for implementing the method according to the invention are concerned, the following information can be given in an entirely nonlimiting manner.

This composition is advantageously of the type of that of the pyrotechnic charges used in gas generators for airbags. However, it will be recalled here that the pyrotechnic charges that are useful for implementing the method according to the invention have dimensions suited to the intended operating time (i.e. greater than that of the pyrotechnic charges that are used in gas generators for airbags).

This composition is advantageously optimized with regard to numerous parameters, such as the combustion temperature, the gas yield, the toxicity of the combustion gases and the pyrotechnic safety.

Thus, the composition of the at least one pyrotechnic charge which is a pressurization gas generator within the context of the implementation of the method according to the invention, advantageously contains:

at least one oxidizing component chosen from the nitrates, such as basic copper nitrate, sodium nitrate, ammonium nitrate, the perchlorates, such as ammonium perchlorate, potassium perchlorate, the dinitramides, such as ammonium dinitramide (ADN), and the metal oxides, such as ferric oxide; and at least one nitrogenous reducing component chosen from guanidine nitrate, nitroguanidine, guanylurea dinitramide, tetrazole, derivatives of the latter and salts thereof, such as 5-aminotetrazole, 5-guanylaminotetrazole, the potassium salt of 5-aminotetrazole, the sodium salt of 5-aminotetrazole, the calcium salt of 5-aminotetrazole, the ammonium salt of bitetrazole, the sodium salt of bitetrazole, the ammonium salt of bitetrazolamine, the sodium salt of 5,5'-azobitetrazole, the calcium salt of 5,5'-azobitetrazole, the triazoles, the dinitramides, the diamides and the polyamine nitrates.

Said composition of the at least one pyrotechnic charge also, optionally, contains:

at least one ballistic catalyst, advantageously chosen from oxides of copper, iron, manganese, cobalt, aluminum, titanium, zirconium, zinc and magnesium; and/or at least one wetting agent, advantageously chosen from organosilanes and titanates, very advantageously chosen from vinyl tris-(2-methoxyethoxy)silane, tris-[3-(trimethoxysilyl)propyl] isocyanurate, γ-glycidoxypropyltrimethoxysilane, diethoxydiacetoxysilane, diacetoxydiethoxysilane and dibutoxyethoxymethylsilane; and/or at least one agglomerating agent, advantageously chosen from silicon oxide and alumina; and/or at least one manufacturing aid, advantageously chosen from carboxylic acid, calcium stearate, silica and mica; and/or a binder, advantageously chosen from oxygenated hydrocarbon-based binders containing an elastomer or a rubber and a plasticizer (such as described in particular in patent application EP 1 216 977), the oxygenated hydrocarbon-based binders obtained by crosslinking an elastomer in the presence of a crosslinking agent and a plasticizer, the molecular mass of which is greater than 350 g/mol and the oxygen balance is equal to or greater than −230% (as described in particular in patent application EP 2 139 828), a PVC (polyvinyl chloride) binder, a silicone binder, a cellulosic binder, a PVA (polyvinyl acetate) binder.

Pyrotechnic charges of which the composition contains such ingredients and which are likely to be used in the scope of the implementation of the method according to the invention have been described in particular in the following patent documents: U.S. Pat. No. 5,608,183, U.S. Pat. No. 6,143,102, FR 2 975 097, FR 2 964 656, FR 2 950 624, FR 2 915 746, FR 2 902 783, FR 2 899 227, FR 2 892 117, FR 2 891 822, FR 2 866 022, FR 2 772 370 and FR 2 714 374.

The pyrotechnic charges which are useful for implementing the method according to the invention are obtained in a conventional manner, and thus advantageously from the ingredients listed above.

They can be obtained using a wet process. According to one variant, the process comprises the extrusion of a paste containing the constituents of the charge. According to another variant, the process comprises a step of placing all (or some) of the constituents into aqueous solution (said step of placing into aqueous solution comprising solubilization of at least one of said main constituents (oxidant and/or reducing agent)), the obtaining of a powder by spray drying the solution obtained, the (possible) addition to said powder of the constituent(s) not placed into solution, and then the shaping of the powder by compression using a dry process in order to obtain the pyrotechnic objects.

The pyrotechnic charges according to the invention can also be obtained (directly) by a dry process. According to one variant, such a process can be limited to simple compression of the powder obtained by mixing the constituents, in order to obtain blocks. According to another variant, such a process can comprise roller compacting, followed by granulation, and then the shaping of the granules, in order to obtain objects. This variant is notably described in patent application WO 2006/134311.

The pyrotechnic charges useful for implementing the method according to the invention can also be obtained by other conventional methods comprising mixing a composition containing a binder in a paddle mixer or twin-screw mixer in order to obtain a paste, followed by the extrusion or the pouring of said paste into molds so as to obtain objects.

As far as the multicomponent, generally two-component, charges are concerned, these can result from the juxtaposition (the stacking) of several previously prepared charges.

In order to obtain pyrotechnic charges which have a part of their surface which is combustion-inhibited, a conventional method is likewise carried out, for example by varnishing their surface to be inhibited.

Among the pyrotechnic charges that have a part of their (combustion) surface which is combustion-inhibited, described above as being suitable for implementing advantageous variants of the method according to the invention, some are novel and particularly advantageous. They form another subject of the present invention.

Let it already be noted that it is not particularly difficult to obtain them. They can be obtained by analogy methods recalled above (wet process, dry process or method involving the use of a binder, in order to obtain one or more blocks, followed by combustion-inhibition of a part of the surface of said block or of the stack of several blocks).

The pyrotechnic charges in question are notably of types A' and A" specified above (illustrated respectively in the appended FIGS. 2 (type A'), 3 (type A"1) and 4 (type A"2)).

The pyrotechnic charge is therefore:

for a charge of type A', a pyrotechnic charge, which has the shape of a right cylinder with a circular cross section and which have a lateral surface extending along its entire length between two end faces, of the solid monolithic block type or of the stack of disks type; one of its two end faces being combustion-inhibited, the other of its two end faces not being combustion-inhibited and its lateral surface being combustion-inhibited only along a part of its length starting from said combustion-inhibited end face. A charge of this type can be seen clearly in the appended FIG. 2;

for a charge of type A", a pyrotechnic charge, which has the shape of a right cylinder with a circular cross section and which have a lateral surface extending along its entire length between two end faces, one of its two end faces and at least a part of its lateral surface starting from said end face being combustion-inhibited, the other of its two end faces not being combustion-inhibited, and which consists of two juxtaposed portions, having different combustion rates at a given pressure, the first portion, of the solid monolithic block type or of the stack of structures type, such as disks or cylinders, which has a non-combustion-inhibited end face corresponding to said non-combustion-inhibited end face of said right cylinder and a lateral surface corresponding to a part of said lateral surface of said right cylinder that is at least partially combustion-inhibited (the charge is then a charge of type A"1) or is not combustion-inhibited (the charge is then a charge of type A"2), having a combustion rate at a given pressure ($Vc_1=a_1P''_1$) that is higher than that ($Vc_2=a_2P''_2$) of the second portion (on account of different pressure coefficients and/or different pressure exponents), of the solid monolithic block type or of the stack of disks type. Charges of this type (which have the overall shape of a right cylinder with a circular cross section, having a first portion with a one-component structure) can be seen clearly in FIGS. 3 and 4 below. The cylindrical shape has been preferred here.

These charges burn with the advantageous "cigarette"-type mode of combustion (see above).

Different aspects of the invention will now be considered with reference to the appended figures.

FIGS. 1, 1', 2, 3 and 4 schematically show, in cross section, pyrotechnic charges suitable for implementing (advantageous variants) of the method according to the invention.

FIGS. 1.1, 2.1 and 3.1 schematically show (without taking the ignition phase of the pyrotechnic charge into consideration) the changes in the flow rates of (generated combustion) gases, pressures in the (liquid) reservoir and the flow rate of (delivered pressurized) liquid, during the implementation of the method according to the invention with combustion of the pyrotechnic charges in FIG. 1 or 1', 2 and 3, respectively.

FIG. 2.2 schematically shows the change in the combustion surface (Scombustion) during the combustion of the pyrotechnic charge in FIG. 2.

Figure 1A:
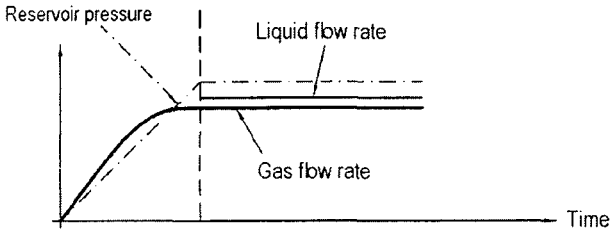
Figure 1A:
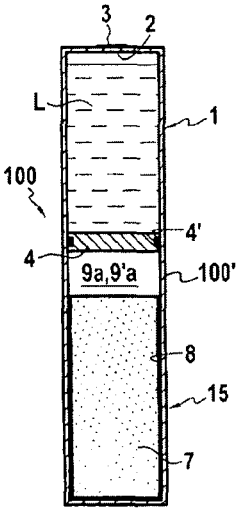
Figure 1B:
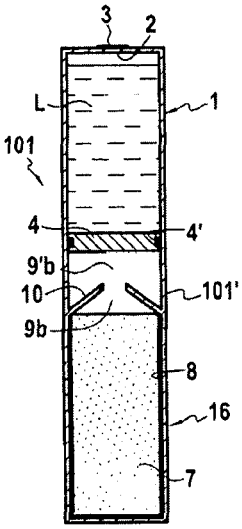
Figure 1C:
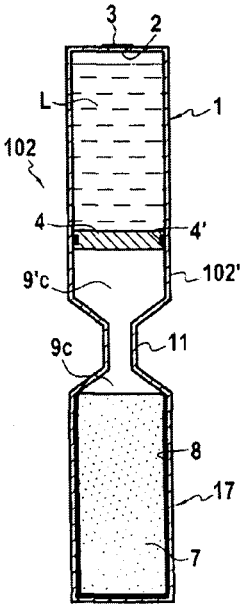

FIGS. 1A, 1B and 1C schematically show, in cross section, devices, loaded with the pyrotechnic charge in FIG. 1 and with the liquid L to be delivered, that are suitable for implementing variants of the method according to the invention.

The charges schematically shown in FIGS. 1, 1', 2, 3 and 4 and the theoretical curves shown in FIGS. 1.1, 2.1 and 2.2 are shown in a context of combustion of said charges where the temperature of the pressurizing gases is constant.

FIG. 1 shows a pyrotechnic charge 7 of type A. This charge, which has a cylindrical shape, of length l, is a monolithic block. It is combustion-inhibited by the varnish 8 on its entire surface, apart from at one of its end faces. FIG. 1' shows a pyrotechnic charge 7', of the same type, which is inhibited in a similar manner and is not monolithic but consists of a stack of several disks.

The charges in FIGS. 1 and 1' have a constant combustion surface (corresponding to the surface of their circular cross section). They burn in an end-burning manner (in a "cigarette"-type manner).

It will easily be understood that the flow rate of generated (combustion) gases increases, is then virtually constant during the pressurization phase (with the combustion pressure increasing) and is then virtually constant during the delivery phase of the liquid (at a constant combustion pressure); FIG. 1.1 schematically shows this time profile of flow rate. As far as the pressure in the reservoir is concerned, it starts by increasing until it reaches the pressure at which the liquid is delivered (transitional phase), the threshold pressure at which the blow-out disk 3 is removed (see FIGS. 1A to 1C). Above this threshold pressure, the pressure is constant. Under the effect of this constant pressure, the liquid is delivered at a constant flow rate.

In FIGS. 1A, 1B and 1C, the same elements bear the same references.

The devices depicted, which are preferred for implementing the method according to the invention (see above) bear the references 100, 101 and 102, respectively. Their unitary (one-piece) structure is delimited by a body 100', 101' and 102', respectively.

The devices 100, 101, 102 comprise a reservoir 1, containing the liquid L. Said reservoir 1 has a delivery port 2 (for said liquid L) that is closed off by a removable blow-out disk 3 (for example of the type of a membrane which is frangible in the form of petals or of the type of a spring-loaded valve). The presence of a gaseous headspace above said liquid L should be noted.

The devices 100, 101, 102 comprise a pyrotechnic gas generator, bearing the reference 15 (FIG. 1A), 16 (FIG. 1B) and 17 (FIG. 1C), respectively. The generators depicted are in fact of three types. Each of said generators contains a pyrotechnic charge 7, of the type depicted in FIG. 1 (i.e. inhibited by the varnish 8 on its entire surface, apart from at its end face intended to be initiated in combustion by an ignition system (not shown)).

Located between each of said generators 15, 16 and 17 and the reservoir 1 is the piston 4 (mobile separating member) which is able to slide in a leaktight manner (see the seals 4') under the action of the pressurizing gases generated by the combustion of the charge 7.

In FIG. 1A, the combustion chamber of the generator 15 bears the reference 9*a*. This combustion chamber 9*a* corresponds to the expansion chamber 9'*a* for the generated gases. It will be clearly understood that such an arrangement allows implementation within the generator 15 of combustion at constant pressure (in the "active phase" the volume of liquid delivered corresponding to the volume of generated gas).

In FIG. 1B, the combustion chamber 9*b* is delimited by a nozzle 10 having a constant throat area. Said nozzle 10 allows "fine" adjustment of the flow rate of pressurizing gases in the expansion chamber 9'*a* and thus of the pressure exerted on the piston 4 and thus of the delivery flow rate of the liquid (during the "active phase").

In FIG. 1C, the combustion chamber 9C is connected to the expansion chamber 9'*c* for the gases by the line 11. It will also be clearly understood that such an arrangement allows the implementation within the generator 17 of combustion at constant pressure (in the "active phase" the volume of liquid delivered corresponding to the volume of generated gas).

FIG. 2 shows a pyrotechnic charge 70 of type A'. This charge, which has a cylindrical shape, of length l, is a monolithic block. It is combustion-inhibited by the varnish 80 at one of its end faces 70*c* and along only a part (corresponding to a length l2) of its lateral surface 70*a*, starting from said end face 70*c*. It is not inhibited at its other end face 70*b*. It is therefore also not inhibited on the complementary part of its lateral surface 70*a* (corresponding to the length l2; l=l1+l2).

With a charge of this type, the combustion is firstly (during the transitional phase) of the end-burning and side-burning type and is then (during the delivery phase of the liquid) only of the end-burning type (end-burning="cigarette"-type combustion). It will thus be understood that said transitional phase (of pressurization of the combustion chamber) is shortened compared with that obtained with a charge such as the one depicted in FIG. 1, inasmuch as, during said transitional phase, the combustion surface is more considerable.

The variation in said combustion surface is shown schematically in FIG. 2.2.

The curves in FIG. 2.1 show the variation in the gas flow rate during the transitional phase (said flow rate decreases as the non-inhibited lateral surface is consumed) and then its constancy during the "active phase" ("cigarette"-type combustion along the length l2), the "rapid" increase in the pressure in the reservoir during said transitional phase and then its constancy during said "active phase", and thus the constancy of the liquid flow rate during said "active phase" ("cigarette"-type combustion along the length l2).

FIG. 3 shows a charge 700 of type A"1.

This charge 700, which has a cylindrical shape, of length l, consists of two juxtaposed cylindrical blocks (portions or parts) 702 and 701. It is inhibited by the varnish 800 at one of its end faces 700*c* and along its entire lateral surface 700*a*. It is not inhibited at its other end face 700*b* which likewise corresponds to the end face 701*b* of the block 701. The lateral surface 701*a* of said block 701, which corresponds to a part of the lateral surface 700*a* of the charge 700 (=701+702), is also inhibited. The combustion of said charge, of its constituent blocks 701 and 702 in succession, is thus "cigarette"-type combustion, successively during the transitional phase and during the "active phase". In order to shorten the duration of said transitional phase, said block 701 has a combustion rate $Vc_1(P)$ greater than the combustion rate $Vc_2(P)$ of the block 702.

FIG. 3.1 shows the constancy of the gas flow rates during the two successive phases ("cigarette"-type combustions), the flow rate during the transitional phase increasing and then becoming greater than the flow rate during the "active phase", as a result of $Vc_1>Vc_2$. The pressure in the reservoir increases rapidly during said transitional phase. The constancy of said pressure and thus that of the flow rate of liquid delivered is then observed ("during the active phase").

FIG. 4 shows a charge 700' of type A"2.

The references in FIG. 3 are given again in this figure, followed by a "". This is because the elements referenced in FIGS. 3 and 4 correspond to one another. It will already have been understood that the only difference between the charges in FIGS. 3 and 4 (which both have a cylindrical shape) is the lack of combustion-inhibition of the lateral surface 701'*a* of the block 701' at a combustion rate $Vc_1$, where $Vc_1(P)>Vc_2(P)$. The combustion of the block 701' is thus of the end-burning and side-burning type (just like that of the first part of the charge 70 in FIG. 2). It will be understood that the variations in the gas flow rate, pressure in the reservoir and liquid flow rate, during the combustion of the charge 700' in FIG. 4, are of the type of those shown in FIG. 2.1, with a more rapid rise in pressure in the reservoir. The effects of both the rapid combustion rate $Vc_1$ and the end-burning and side-burning combustion are combined.

The invention claimed is:

1. A method for delivering a liquid contained in a reservoir, said reservoir having at least one delivery port for delivering said liquid which is closed off by a blow-out disk that is removable at a threshold pressure applied to said liquid, comprising:

carrying out a combustion of at least one pyrotechnic charge in order to generate combustion gases;

pressurizing said liquid under the action of said combustion gases, and removing said removable blow-out disk from said at least one delivery port and delivering said pressurized liquid, wherein a flow rate of generated combustion gases during the delivery of said liquid ensures a virtually constant pressurization of said liquid, a pressure of said liquid during the delivery of said liquid varying only by a maximum of +/−30% with respect to its initial value at a time at which said blow-out disk is removed, and thus the delivery of said liquid at a virtually constant flow rate, a flow rate of said liquid during the delivery of said liquid varying only by a maximum of +/−30% with respect to its initial value at a time at which said blow-out disk is removed, wherein said method is implemented in a device comprising said reservoir and at least one pyrotechnic gas generator containing said at least one pyrotechnic charge said at least one pyrotechnic gas generator being connected to said reservoir and a mobile member for separating the generated combustion gases and said liquid being provided within said device, and wherein the at least one pyrotechnic charge, which is of the solid monolithic block type or of the stack of disks type, has a shape of a right cylinder with a circular cross section and a lateral surface extending along its entire length between two end faces, the lateral surface being combustion-inhibited along a part of the length of the cylinder starting from one of the two end faces, which is itself combustion-inhibited, and not being combustion-inhibited along the complementary part of the length of the cylinder starting from the other end face of the two end faces which is not combustion-inhibited, so that during the pressurization of said liquid, said at least one pyrotechnic charge is end-burning and side-burning while during the delivery of said liquid the at least one pyrotechnic charge is end-burning only.

2. The method as claimed in claim 1, wherein the combustion of said at least one pyrotechnic charge is implemented with the combustion pressure being regulated.

3. The method as claimed in claim 1, wherein said pressurized liquid is delivered in a dispersed form.

4. The method as claimed in claim 1, wherein said liquid is a fire extinguishing agent, a lubricant, a cooling agent, or a cleaning and/or dispersant agent.

5. The method as claimed in claim 1, wherein said device comprises a one-piece body in which said reservoir and said at least one gas generator are arranged, or wherein, within said device, said at least one gas generator is arranged in said reservoir.

6. The method as claimed in claim 1, wherein said device comprises a body with a sliding piston as the mobile member; said piston delimiting two chambers, a first chamber that forms said reservoir and a second chamber that contains said at least one pyrotechnic charge forming the pyrotechnic gas generator.

7. A pyrotechnic charge, suitable for implementing the method as claimed in claim 1, having a shape of a right cylinder with a circular cross section and having a lateral surface extending along its entire length between two end faces, of the solid monolithic block type or of the stack of disks type, wherein one of the two end faces is combustion-inhibited, while the other of the two end faces is not combustion-inhibited, and the lateral surface is combustion-inhibited only along a part of its length starting from said combustion-inhibited end face.

8. The method as claimed in claim 1, wherein the pressure of said liquid during the delivery of said liquid varies only by a maximum of +/−20% with respect to its initial value at the time at which said blow-out disk is removed.

9. The method as claimed in claim 1, wherein the pressure of said liquid during the delivery of said liquid varies only by a maximum of +/−10% with respect to its initial value at the time at which said blow-out disk is removed.

* * * * *